US006929588B2

(12) United States Patent
Hobson

(10) Patent No.: US 6,929,588 B2
(45) Date of Patent: Aug. 16, 2005

(54) EXERCISE EQUIPMENT

(76) Inventor: Donald A. Hobson, 4600 Don Quixote, Los Angeles, CA (US) 90008-4111

( * ) Notice: Subject to any disclaimer, the term of this patent is extended or adjusted under 35 U.S.C. 154(b) by 0 days.

(21) Appl. No.: 10/436,696

(22) Filed: May 13, 2003

(65) Prior Publication Data

US 2004/0229738 A1 Nov. 18, 2004

(51) Int. Cl.[7] ..... A63B 25/08

(52) U.S. Cl. ..... 482/138; 482/77; 472/134; 273/458

(58) Field of Search ..... 482/15, 27–29, 482/77, 138; 280/87.051; 472/134; 273/457, 458

(56) References Cited

U.S. PATENT DOCUMENTS 3,627,314 A * 12/1971 Brown ..... 482/77
4,438,919 A * 3/1984 Gamzo ..... 472/134
5,275,426 A * 1/1994 Tankersley ..... 280/87.051

* cited by examiner

*Primary Examiner*—Glenn Richman

(57) ABSTRACT

An exercise platform for low-impact exercises that is of a resilient shell that can contain components, such as liquids, foams, pellets, solids, and gases, but more typically air. This filled shell gives the desired resistance and passivity to the exercise platform and provides a surface that produces low to almost no impact when, jogging, bouncing, etcetera. The platform can have a rigid base or frame with removable or collapsible legs, and/or casters used for height adjustment and mobility. Slots, hooks, or other means can join multiple platforms to form a larger surface for reclined exercises. The platform and/or its frame also has one or more inlets for rigid vertical members that terminate as handle bars or an overhead bar(s) for auxiliary upper body exercise equipment. A decorative cover transforms the exercise platform into furniture when not in use.

18 Claims, 5 Drawing Sheets

EXERCISE EQUIPMENT

BACKGROUND OF INVENTION

1. Field of the Invention

The present invention generally concerns exercise equipment and particularly relates to exercise equipment of the type that allows for low impact aerobic and rehabilitative exercises.

2. Description of the Prior Art

A number of exercise platforms are presently in use. Typically, conventional exercise platforms are either trampolines or platforms with hard surfaces and some padding. Most conventional exercise equipment attempt to limit and/or minimize stress and strain to certain, if not all, body parts that are ultimately injurious to the human body. However, most exercise equipment does not completely accomplish this end. Commonly, exercise equipment is not serviceable to extremely overweight people nor is it accommodating to individuals who are not agile. Moreover, conventional exercise equipment does not accommodate individuals with pre-existing injuries nor those needing rehabilitative exercise.

U.S. Pat. No. 5,033,742 (Johnson et al) shows inflatable device for aiding sit-ups only, U.S. Pat. No. 4,759,543 (Feldman) is just for exercising the back and U.S. Pat. No. 4,336,33 (Applebaum) is just for bouncing and jogging.

SUMMARY OF THE INVENTION

The present invention addresses the foregoing problems by providing an exercise platform that is of a rubberized or elastic (pliable) shell containing varying components such as liquids, solids, and gases, but more typically air. This filled shell will give the desired resistance and passivity to the exercise platform and provide a surface that produces low to almost no impact.

Thus, in one aspect, the invention concerns a step platform exerciser that has for its base a rubberized pillow filled with air. The assembly includes a collapsible frame and an extendible handlebar for the operator's balance allowing an individual to perform walking or jogging or stepping.

In another aspect, the invention is large enough to accommodate a person's body in any position or pose, such that this surface absorbs and redistributes forces that would otherwise be directed to harmful areas of the exerciser's body. Also, smaller platforms may be connected together to perform this task.

An example would be an individual doing sit-ups and/or stomach crunches. Stomach crunches evolved from taking the stress off the spine while doing sit-ups. This invention further relieves this stress by absorbing and redistributing these harmful forces away from the vulnerable spine.

A further aspect is that the platform has raised sides providing a greater range of exercise movements, for example rocking.

DESCRIPTION OF THE PREFERRED EMBODIMENTS

Figure 1:
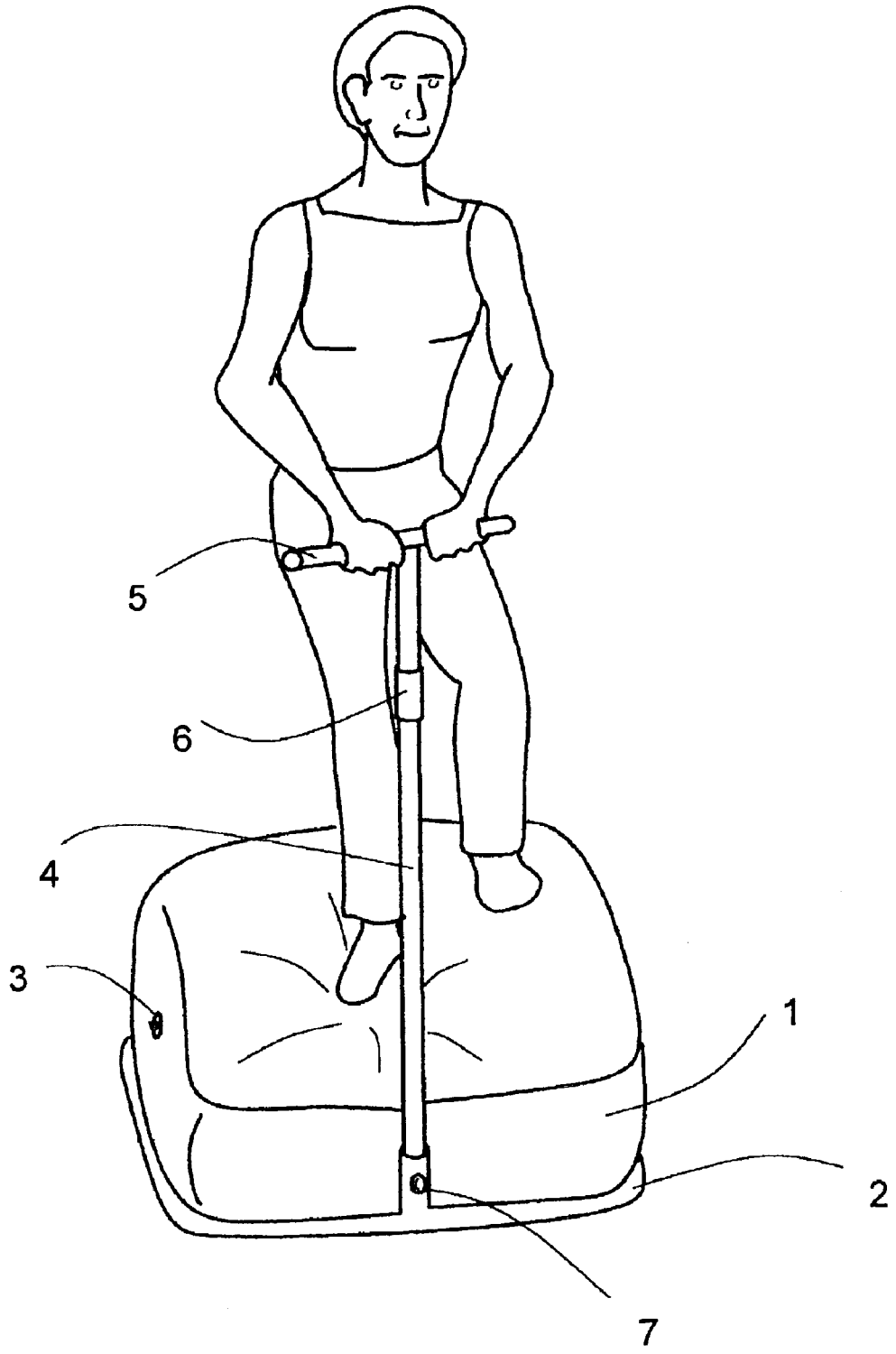
FIG. 1 is a perspective view of the exerciser platform according to a representative embodiment of the invention.

FIG. 1 illustrates an individual doing a walking, running or stepping exercise on the exerciser platform 1 while holding on to the adjustable handle 5 connected to the frame 2 by a pole 4 with an adjustable nut 6 an inlet valve 3 enables inflation and deflation.

Figure 2:
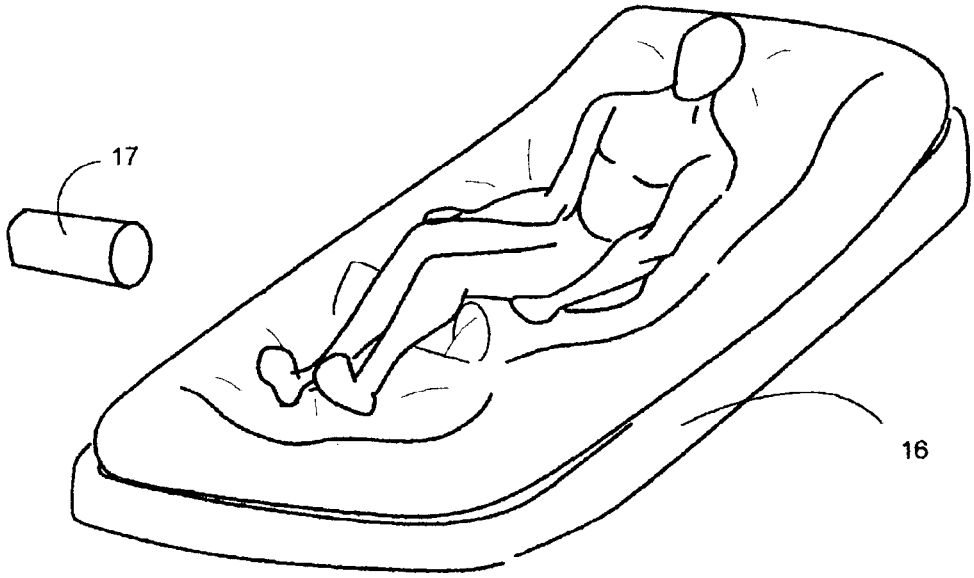
FIG. 2 is a side view of the larger exerciser platform according to a representative embodiment of the invention.

FIG. 2 illustrates an individual lying on a larger tube 16 doing stomach crunches with an additional pillow 17.

Figure 3:
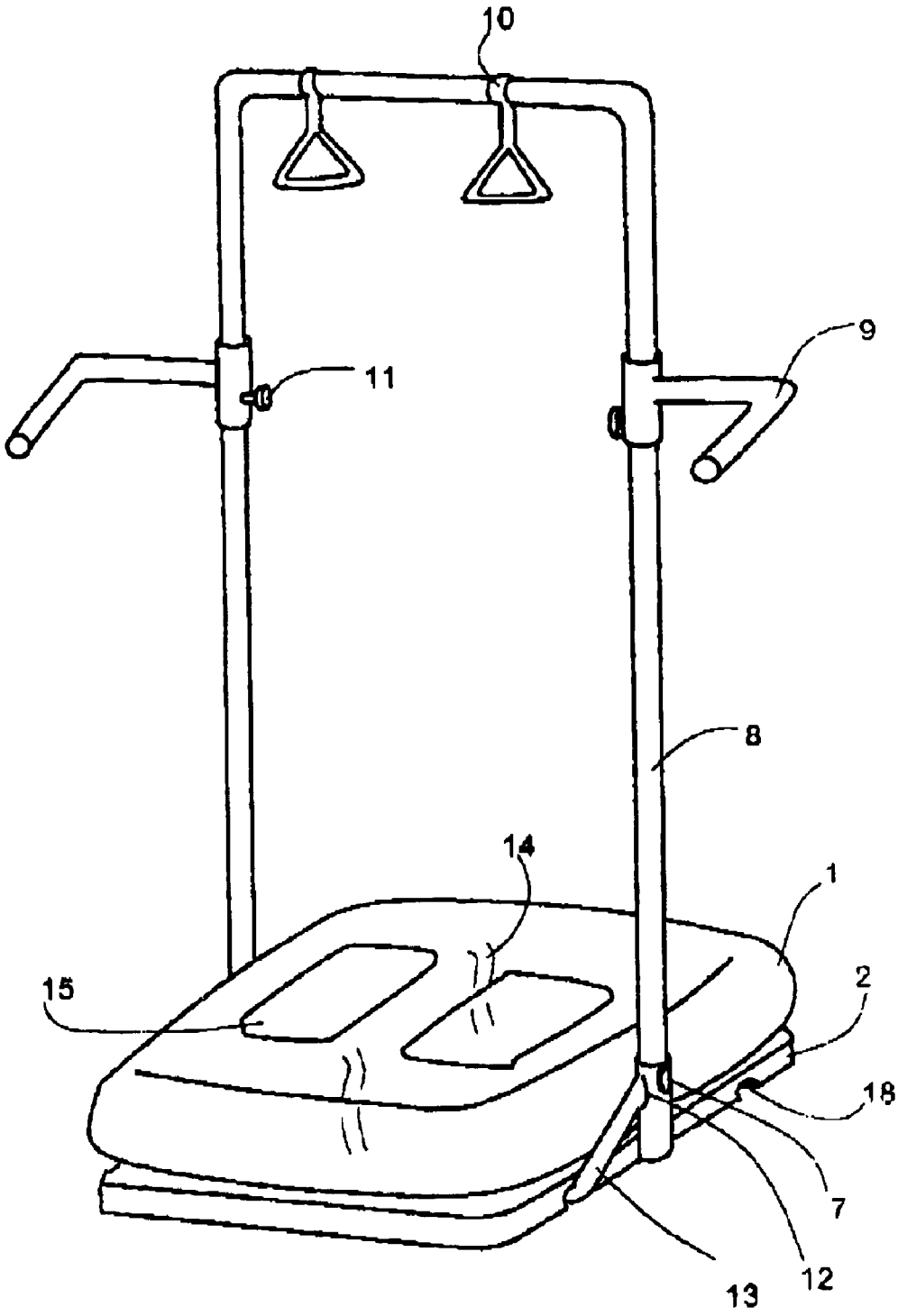
FIG. 3 is a perspective view of the exerciser platform having auxiliary exercise accessories according to a representative embodiment of the invention.

FIG. 3 illustrates the auxiliary accessories such as a removable upper bar 8 with adjustable accessory elements 9 and 10, which allow for upper body and extremity exercises hard patches 15 which can restrict flexure of the feet while jogging and while doing other leg exercises. Ligatures 14 restrict the height of ballooning when weight is applied to the platform. Stability is enhanced by weight of the base and extensions 13 of the auxillary receptacle 12, which has knobs 11 for tightening.

Figure 4:
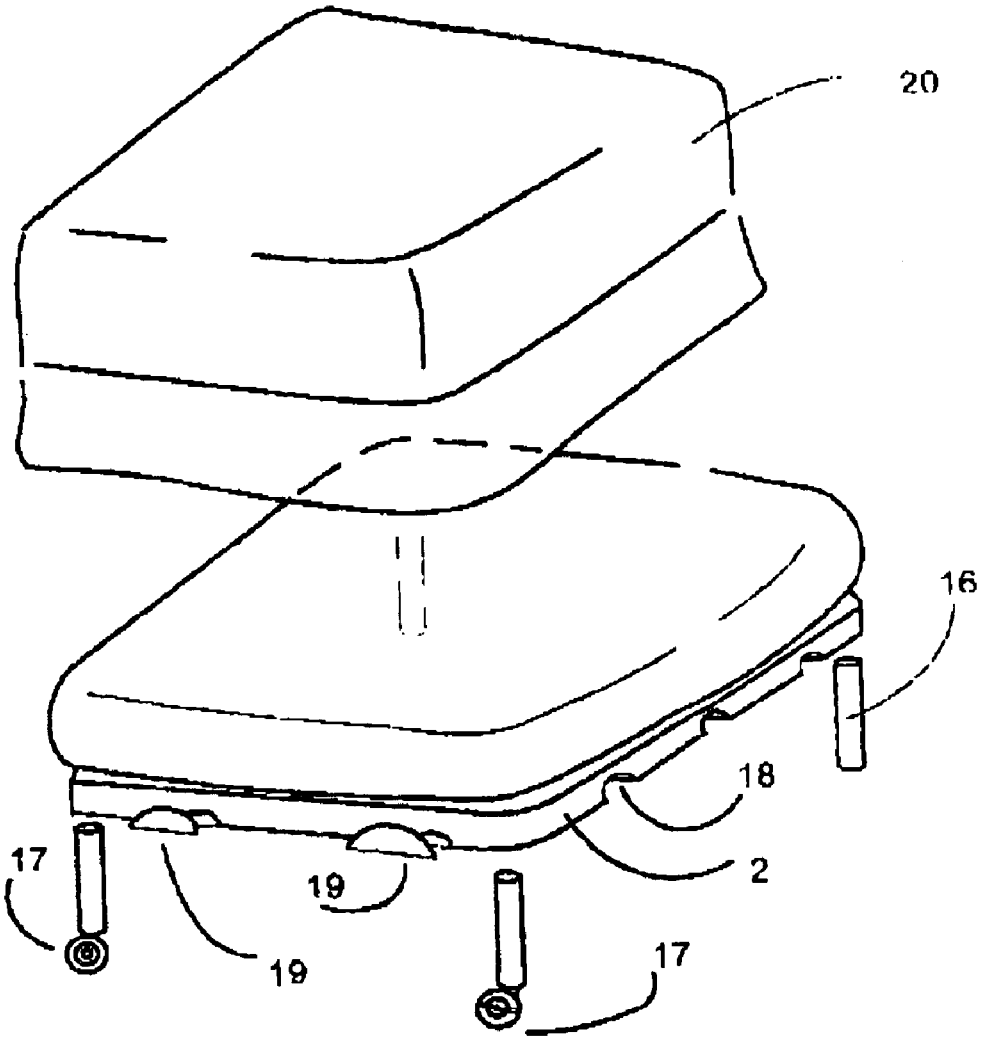
FIG. 4 is a perspective view of the exerciser platform showing detachable legs, casters and means of connecting platforms together.

FIG. 4 illustrates an exercise platform with removable legs 16, casters 17, slots 18 and hooks 19 for joining additional platforms and a decorative cover 20.

Figure 5:
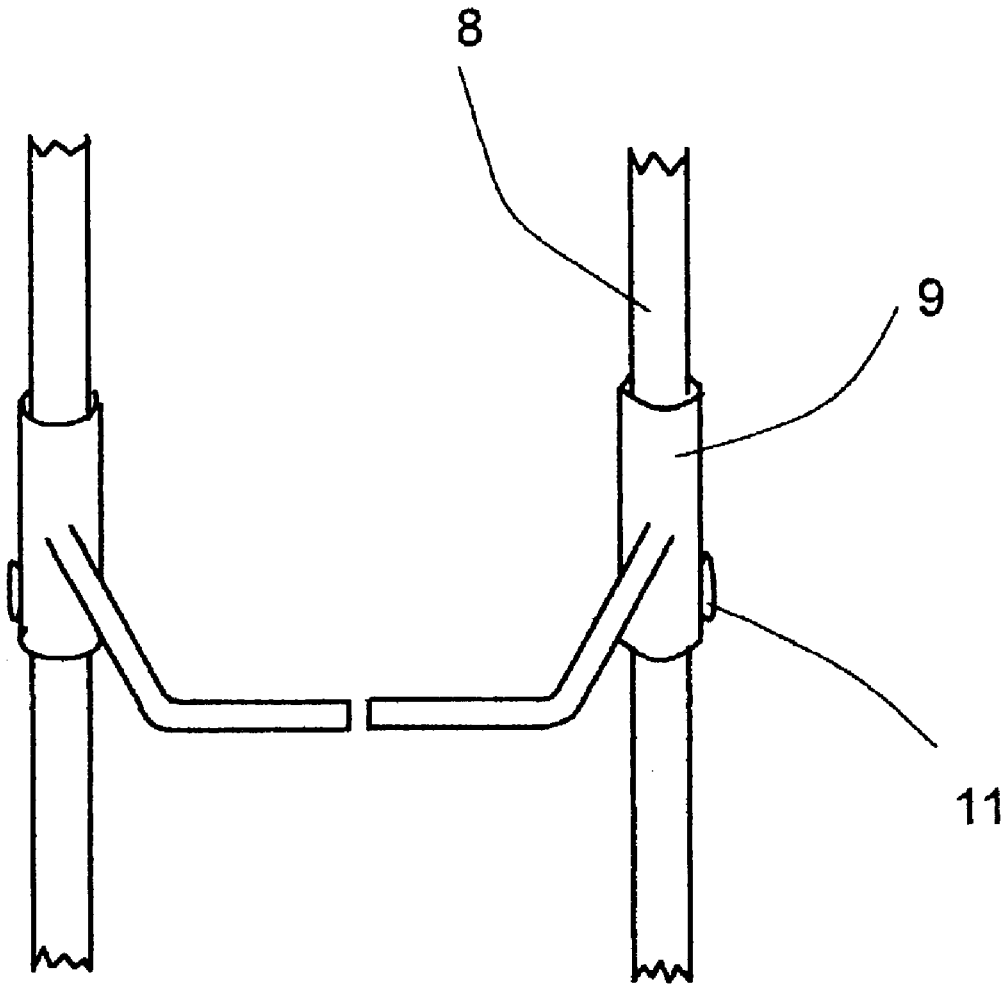
FIG. 5 is a cut-away view showing still other forms of auxiliary exercise accessories.

FIG. 5 is a cut-away view of adjustable horizontal bars 9 attached to upper bar 8 held secure by adjustment knob 11 providing yet more exercise possibilities.

Conclusion

As noted above, most step exercisers, exerciser platforms and exercise mats are either too rigid or too springy thereby raising the amount of impact or stress applied to the vulnerable areas of the human body. The present invention addresses these problems in a number of different respects thereby allowing very low to no impact to these areas while doing exercises.

It is if to be understood that the phraseology or terminology Employed herein is for the purpose of description and not of limitation. Accordingly, the invention is intended to embrace all such alternatives, modifications, equivalents and variations as fall within the broad scope of the appended claims.

Although the present invention has been described in detail with regard the exemplary embodiments and drawings thereof, it should be apparent to those skilled in the art that various adaptations and modifications of the present invention may be accomplished without departing from the spirit and scope of the invention. Accordingly, the invention is not limited to the precise embodiment shown in the drawings and described in detail hereinabove. Rather, it is intended that all such variations not departing from the spirit of the invention be considered as within the scope thereof as limited solely by the claims appended hereto.

Also, several different embodiments of the present invention are described above, with each such embodiment described as including certain features. However, it is intended that the features described in connection with the discussion of a single embodiment are not limited to that embodiment but may be included and/or arranged in various combinations in any of the other embodiments as well, as will be understood those skilled in the art.

In the following claims, those elements which do not include the words "means for" are intended not to be interpreted under 35 U.S.C. §112 ¶6.

What is claimed is:

1. A stationary exercise apparatus for lower impact exercise comprising: a platform, a pliable balloon containing a fluid, solid, air or any combination of these to achieve the desired flexibility and resiliency, a detachable main frame removably connected to said platform, and an auxillary detachable pole that extends to an adjustable height and terminates as a handle, the frame having means for attaching exercise accesories, wherein the apparatus can be used without the auxiliary detachable pole and the detachable main frame to accommodate individuals with various physical limitations and abilities.

2. An exercise platform according to claim 1, wherein the frame is provided with auxiliary casters for ease of movement when said platform is not in use or used as furniture.

3. An exercise platform according to claim 1, wherein at least one caster can be provided with a brake.

4. An exercise platform according to claim 1, wherein the frame has a hook system to attach one or more exercise platforms together.

5. An exercise platform according to claim 1, wherein a removable decorative cover is placed when not in use.

6. An exercise platform according to claim 1, wherein the frame has loops and anchors for attaching accessory exercise items such as elastic pulley(s) for arm and upper torso exercises.

7. An exercise platform according to claim 1, wherein the resilient balloon is made of rubber or elastic material.

8. An exercise platform according to claim 1, wherein the platform is filled with air and is provided with a pressure valve for filling and emptying.

9. An exercise platform according to claim 1, wherein the frame has an attachment means to accommodate various attachments to increase the number of exercises that can be done.

10. An exercise platform according to claim 1, wherein said frame attachments can have adjustable accessory elements to provide upper body and extremity exercises.

11. An exercise platform according to claim 1, wherein the frame has removable or collapsible legs and/or wheels and a decorative slip cover for conversion to furniture when not in use.

12. An exercise platform according to claim 1, wherein the platform has a ligature means to restrict the height of ballooning when weight is applied.

13. An exercise platform according to claim 1, wherein removable hard plates can be applied to restrict foot flexure while jogging or doing other leg or foot exercises.

14. An exercise platform according to claim 1, wherein additional pillows provide expanded exercise capabilities.

15. An exercise platform according to claim 1, wherein said frame is weighted for additional stability.

16. An exercise platform according to claim 1, wherein said platform is large enough to accommodate a fully prone human body or several bodies, for expanding abdominal and other exercises.

17. An exercise platform according to claim 1, wherein said frame is collapsible for storage.

18. An exercise platform according to claim 1, wherein said frame has slots on its base to change accessory positions.

* * * * *